United States Patent [19]

Burchfield et al.

[11] Patent Number: 4,534,476

[45] Date of Patent: Aug. 13, 1985

[54] BRIDGE CRANE

[75] Inventors: William L. Burchfield, Tacoma; Edward L. Carr; Gordon J. Laskowski, both of Port Orchard, all of Wash.

[73] Assignee: The United States of America as represented by the Secretary of the Navy, Washington, D.C.

[21] Appl. No.: 510,703

[22] Filed: Jul. 5, 1983

[51] Int. Cl.[3] ..... B66C 23/52; B66C 17/00; B66C 11/02

[52] U.S. Cl. ..... 212/190; 212/205; 212/209; 212/216

[58] Field of Search ..... 212/205, 209, 210, 211, 212/216, 190

[56] References Cited

U.S. PATENT DOCUMENTS

| | | | |
|---|---|---|---|
| 457,441 | 8/1891 | Naylor . | |
| 1,866,801 | 7/1932 | Ferris . | |
| 2,847,131 | 8/1958 | Miller | 212/128 |
| 2,906,413 | 9/1959 | Minty | 212/20 |
| 3,018,902 | 1/1962 | Minty | 212/20 |
| 3,105,596 | 10/1963 | Gagnon et al. | 212/32 |
| 3,482,715 | 12/1969 | Worthington | 214/75 |
| 3,550,788 | 12/1970 | Auzins | 212/128 |
| 3,738,501 | 6/1973 | Gill | 212/125 |
| 3,786,936 | 1/1974 | Staadt | 212/209 |
| 3,973,683 | 8/1976 | Keller | 214/1 BB |
| 4,290,584 | 9/1981 | Eckels et al. | 182/2 |
| 4,372,452 | 2/1983 | McCord | 212/159 |

FOREIGN PATENT DOCUMENTS

| | | | |
|---|---|---|---|
| 13247 | 2/1977 | Japan | 212/159 |
| 570402 | 7/1945 | United Kingdom | 212/214 |

*Primary Examiner*—Trygve M. Blix
*Assistant Examiner*—R. B. Johnson
*Attorney, Agent, or Firm*—R. F. Beers; C. D. B. Curry; W. C. Daubensepck

[57] ABSTRACT

A bridge crane for use in a shipboard environment consisting of a machinery carrying body having a bolt-on hoist rail. The ends of the machinery carrying body form trucks housing support wheels for suspending the crane from overhead rails. The traversing system is disposed in the machinery body and consists of an air motor coupled to drive pinions which engage a gear rack on each overhead rail. The traversing systems and a pneumatically powered hose reel for holding an air hose for a pneumatically powered hoist are powered from a central air supply through a pneumatic control circuit.

3 Claims, 7 Drawing Figures

BRIDGE CRANE

BACKGROUND OF THE INVENTION

This invention relates in general to overhead material handling systems and, in particular to a bridge crane that is adaptable to different hoists, hoist loads, and handling system configurations.

This invention is directed to a bridge crane for operation in an overhead material handling system used in a shipboard environment. In such material handling systems, overhead cranes are supported for movement along a pair of overhead I-beams. The cranes are provided with a hoist rail extending transversley to the direction of movement of the crane for supporting a movable hoist. As the crane moves along its path of travel, the hoist rail comes into alignment with crossover rails which lead to other parts of the work area or other crane tracks. In the case of a shipboard system, the crane must retain hoist transport capability after being subjected to shipboard environmental vibration. In case of military combat vessels, the crane must also withstand high impact shock originating from a near miss in combat conditions.

Previous shipboard cranes have been designed with integral hoist rails which make the crane unique to a particular load, hoist or handling system configuration. There is a need for a crane having the capability of operating in a shipboard environment and which is adaptable to different hoists, hoist loads, and handling systems with a minimum of changes. Using the same crane in different handling systems allows a reduction in spare part inventories, minimizes the maintenance training, and allows operators to transfer from one handling system to another with a minimum of further training.

SUMMARY OF INVENTION

It is therefore an object of the present invention to provide a bridge crane for horizontally transporting a hoist in a shipboard overhead handling system.

Another object is to provide a bridge crane that retains hoist transport capability after being subjected to shipboard environmental vibration and high impact shock.

Another object is to provide a shipboard bridge crane that is easily adaptable to different handling systems configurations.

Another object is to provide a bridge crane which is entirely pneumatically powered.

These and other objects are provided by a bridge crane consisting of a machinery carrying body having a bolt-on hoist rail. The ends of the machinery carrying body form trucks housing support wheels for supporting the crane from overhead rails. The traversing system is disposed in the machinery body and conists of an air motor coupled to drive pinions which engage a gear rack on each overhead rail. The traversing systems and a pneumatically powered hose reel for holding an air hose for a pneumatically powered hoist are powered from a central air supply through a pneumatic control circuit.

Other advantages and features of the present invention will be apparent from the following detailed description when considered in conjunction with the following drawing wherein:

DESCRIPTION OF THE PREFERRED EMBODIMENT

Figure 1:
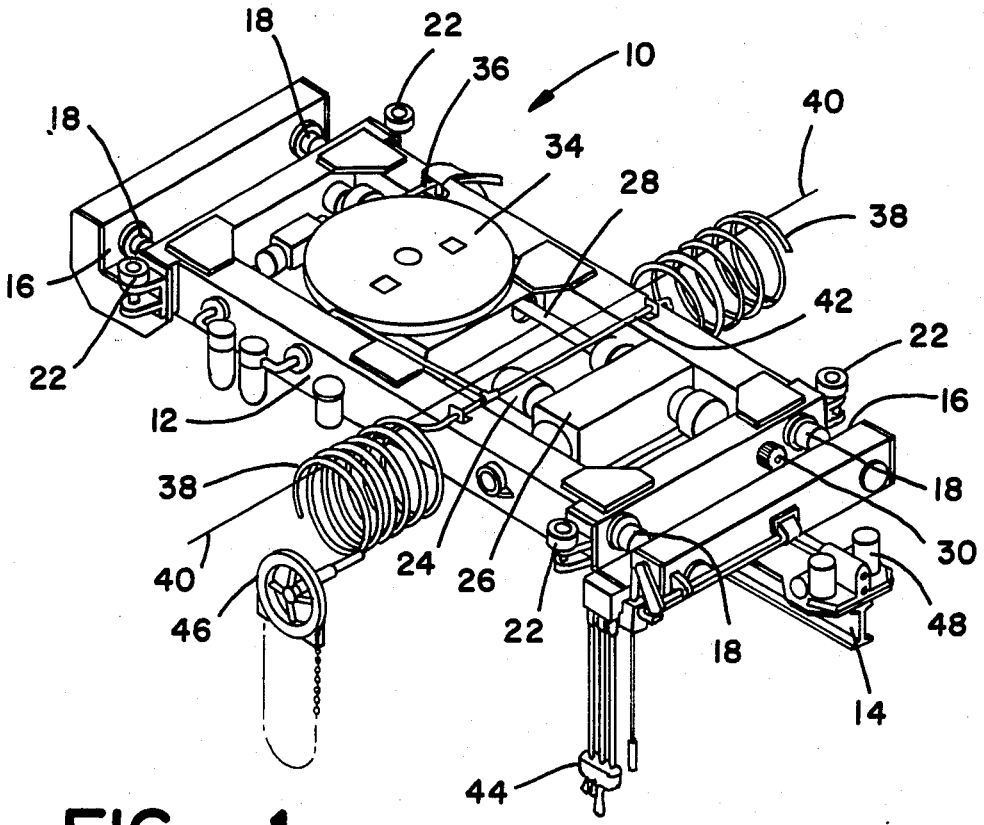
FIG. 1 is a perspective view of a bridge crane according to the present invention.
Figure 2:
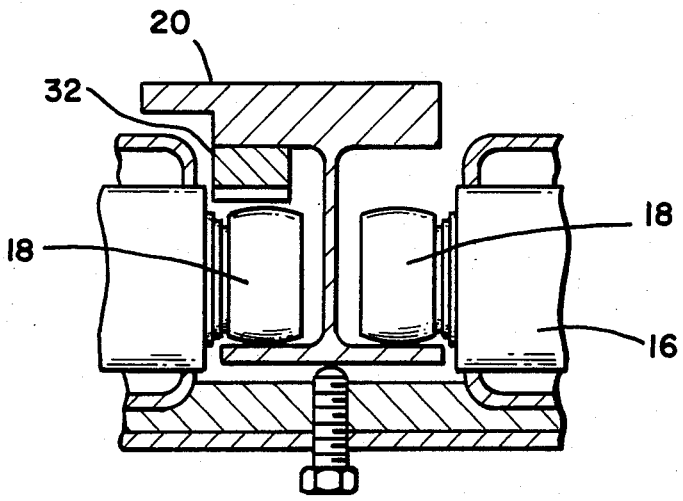
FIG. 2 is a fragmentary view illustrating the crane support apparatus.

Referring now to the drawings and, in particular to FIG. 1, the bridge crane 10 consists, generally, of a machinery box 12 and a bolt-on hoist rail 14. The ends of the machinery box 12 form trucks 16 that house support wheels 18 which suspend the crane from overhead crane support rails 20 as illustrated in FIG. 2. The trucks 16 also carry guide rollers 22 to prevent the crane 10 from crabbing when the crane is traversing on the overhead support rails.

The traversing system consists of an air motor 24 coupled to drive gear box 26 which is coupled to a drive shaft 28. The driveshaft 28 is coupled at each end to a drive pinion 30 which engages a gear rack 32 (See FIG. 2) on each overhead support rail 20. A pneumatically powered hose reel 34 is mounted on the machinery box 12. The hose 36 wound on the hose reel 34 couples an air supply to a pneumatically powered hoist (not shown) which runs on the hoist rail 14. Air for powering the traversing motor 24, the hose reel 34 and the hoist is provided from a central compressor system through a self-coiling tubing 38 that is supported by suspension line 40 along the path of the crane 10. The self-coiling tubing 38 maybe coupled to the crane air piping 42 at the either side of the crane as shown. A hand held pendant control 44 is suspended from the crane 11 to provide operator control of the speed and direction of the crane travel. A manual drive assembly 46 is provided to traverse the crane if pneumatic power is temporarily lost.

The bottom of the machinery box 12 provides a mounting surface for the bolt-on hoist rail 14. The hoist rail 14 is either a standard I-beam or a fabricated member whose length, depth, and physical properties are chosen to suit a given hoist, load, and handling system configuration. The hoist rail 14 carries rail interlocking and hoist stop apparatus 48 at each end to allow the hoist to transfer to another hoist rail only when the two hoist rails are aligned. The details of a preferred rail interlocking and hoist stop apparatus are described in copending patent application Ser. No. 510,702 filed July 5, 1983 now patented.

Figure 3:
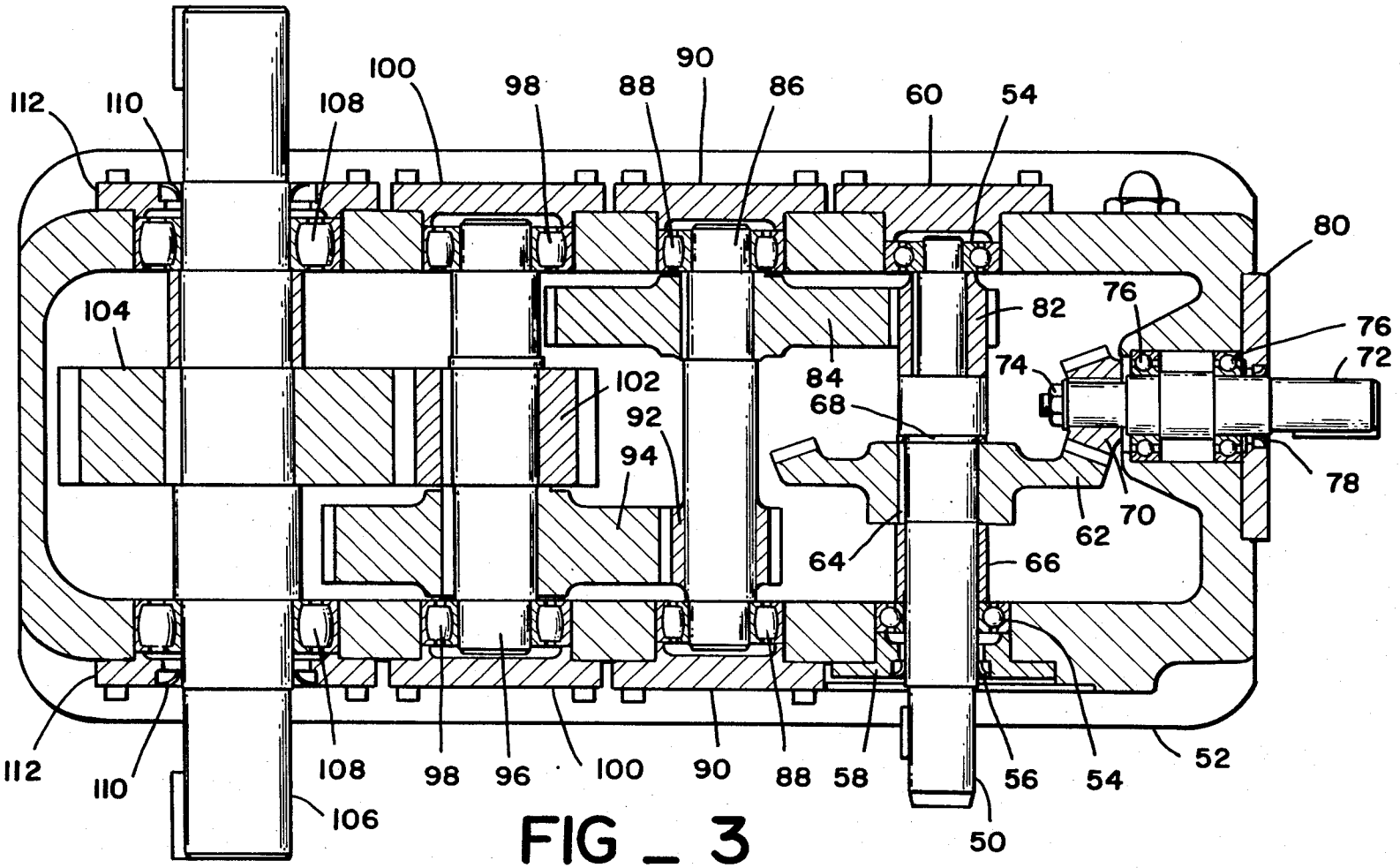
FIG. 3 is a horizontal sectional view of the gear box.

Turning now in more detail to the traversing system and referring to FIG. 3, which shows a horizontal sectional view of the crane gear box 26, the output shaft (not shown) of the air motor 24 is coupled to an input shaft 50. The input shaft 50 is supported in gear box causing 52 and rotates on ball bearings 54. The input shaft 50 extends through a sealed aperture 56 in cover 58 at one end and is capped by a closed cover 60 on the other end. These covers and other similar covers to be described later are held in place by appropriate fasteners such as the screws shown (unnumbered).

A spiral bevel gear 62 keyed (at 64) to the input shaft 50 is disposed between spacers 66 and 68. The spiral gear 62 meshes with a spiral bevel pinion 70 attached at the end of a brake shaft 72 by nut 74. The brake shaft 72 rotates on ball bearings 76 mounted in casing 52 and extends through a sealed aperture 78 in cover 80. The brake shaft 72 is coupled to a locking means (not shown) so that the brake shaft may be locked to prevent traversal of the crane. The manual drive assembly 46 (not shown) maybe coupled to the brake shaft 72 for manual rotation of the input shaft 50 if pneumatic power is temporarily lost.

A pinion 82 is keyed to the output and of the input shaft 50. Pinion 82 meshes with a spur gear 84 which is keyed to a first intermediate shaft 86 that rotates on ball bearings 88 maintained in the casing by end caps 90. The first intermediate shaft 86 has a pinion like section 92, which meshes with a spur gear 94 which is keyed to a second intermediate shaft 96. The second intermediate shaft 96 rotates on ball bearings 98 and is maintained in place by end caps 100.

A pinion 102 is keyed on the center of the second intermediate shaft 96 to mesh with a spur gear 104 keyed to an output shaft 106. The output shaft 106, which rotates on ball bearings 108 and extends through sealed apertures 110 in end caps 112, is in line with the drive pinions 30.

Figure 4:
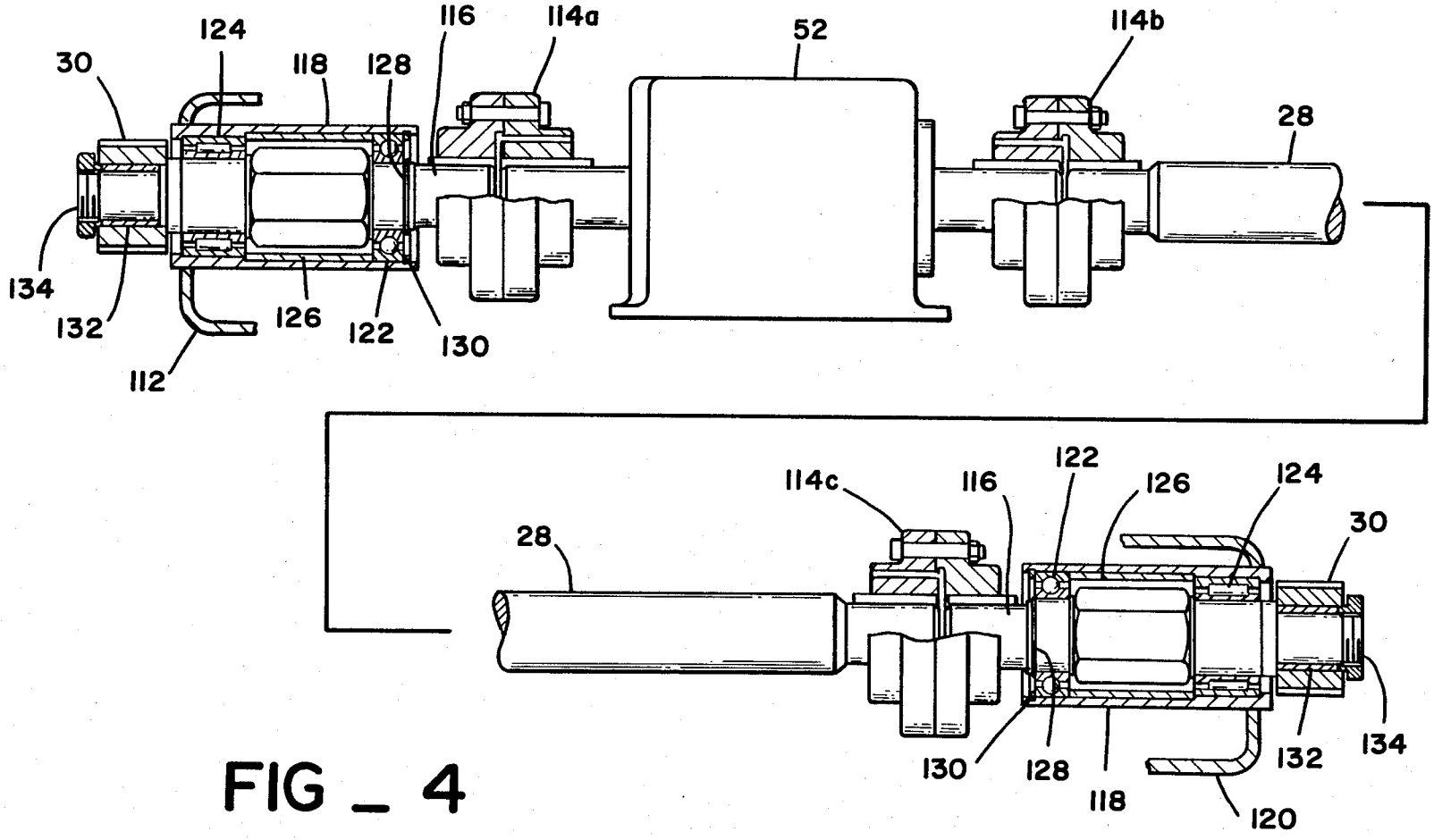
FIG. 4 is a sectional view of the drive component assembly.

Referring now to FIG. 4 which shows the drive shaft assembly 28, each end of the output shaft 106 from the gear box 26 is keyed to the fixed end of a single engagement geared flexible coupling 114A and 114B. The flexible end of the flexible coupling 114B (in the center as shown in FIG. 4), is coupled to the drive shaft 28. The other end of the drive shaft 28 is coupled to the fixed end of a third flexible coupling 114C. The outer flexible ends of the outer flexible couplings 114A and 114C are each keyed to a pinion shaft 116. The pinion shafts 116 extend through boxes 118 mounted in the machinery box walls 120 to join with the drive pinions 30. The shafts 116 rotate within the boxes 118 on bearings 122 and 124. The shafts 116 and bearings 122 and 124 are maintained in place within the boxes 118 by a sleeve 126 and an internal retaining ring 128 and an external retaining ring 130. The drive pinions 30 are mounted on the shaft over four bushings 132 which are retained in place by a pinion hub nut 134. The bushings 132 and hub nut 134 function as an overload release clutch which allows the pinion to rotate relative to the shaft 116 at torque value greater than a preselected value as set by the tightness of the hub nut.

Figure 5:
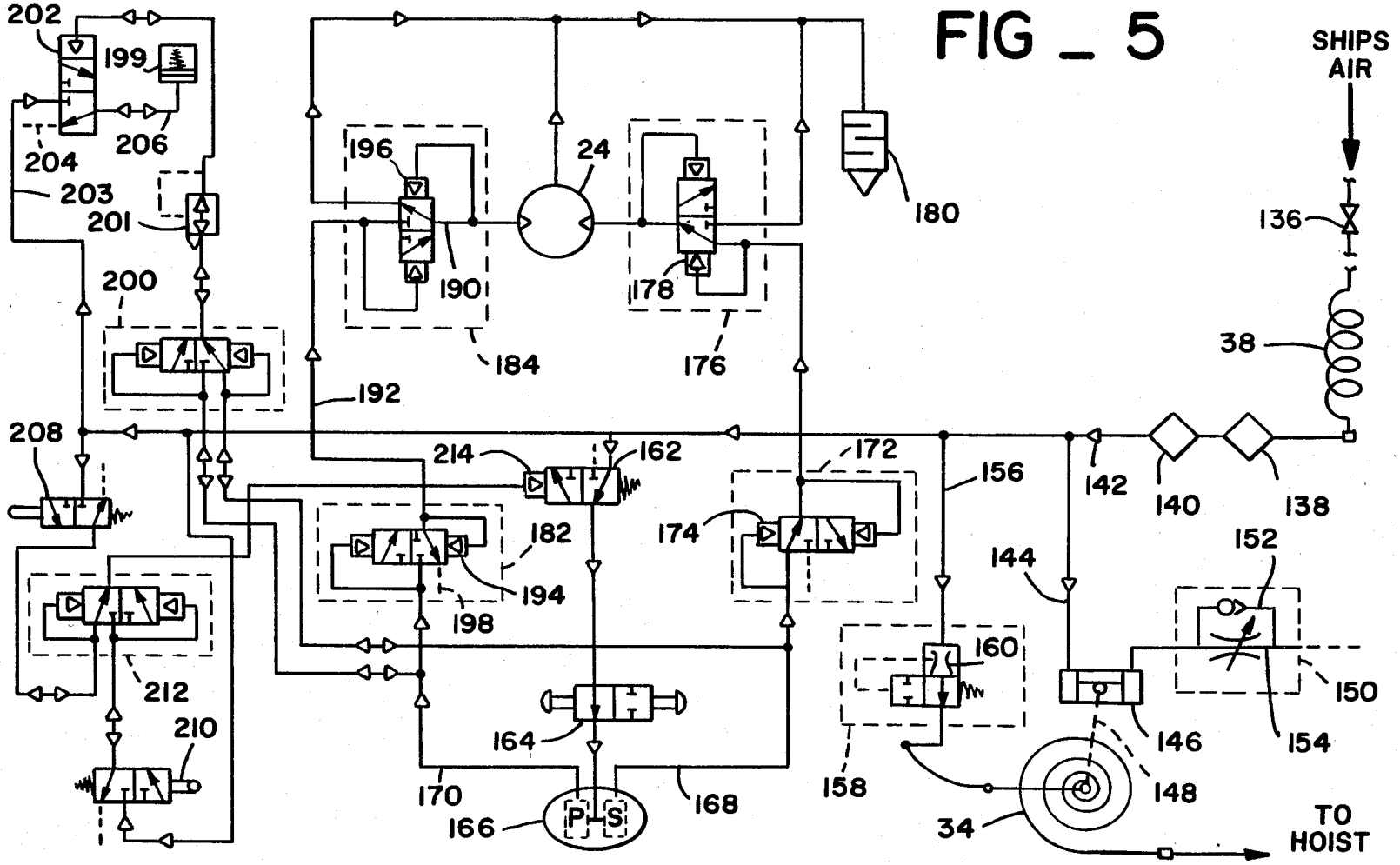
FIG. 5 is a schematic illustration of a pneumatic circuit for use with the crane of the present invention.

Referring now to FIG. 5, which illustrates a pneumatic circuit for controlling the hoist, hose reel, and crane motor from the ship's air supply, high pressure air (e.g. 125 p.s.i.) from the shipboard central compressor system is coupled through a shut off valve 136 to the self-coiling air hose 38 for connection to the crane air piping. The pressurized air is filtered and lubricated at 138 and 140, respectively, after it is received at the crane. The arrowheads in the various pneumatic lines such as arrowhead 142 indicate the direction of air flow in those lines. After being lubricated at 140, the pressurized air is coupled by line 144 to pressurize a rotary actuator 146 which drives the hose reel 34 in the takeup direction via mechanical linkage 148. The rotary actuator 146, which includes two piston heads connected by a rack which drives a pinion coupled to the linkage 148, is vented through an adjustable air flow check valve 150. During hose payout, air freely flows into the actuator through check path 152 of valve 150. During hose takeup, air is vented through the restricted flow path 154 to generate a back pressure which limits the speed at which the rotary actuator 146 can rewind the hose 38. A preferred embodiment of the hose reel is disclosed in copending patent application Ser. No. 510,031 filed July 7, 1983.

The pressurized air is also coupled, via pneumatic line 156 and an excess flow check valve 158, to supply the air hose 36 wound on the hose reel 34. The excess flow check valve 158 functions as an "air fuse" to interrupt the air supply to the hose 36 in case the air hose ruptures. When the valve 158 detects an excess flow through a venturi region 160, the valve (shown in its open position) will shift to the closed position to interrupt the air supply.

Turning now to the control circuit for the crane drive air motor 24, the air supply is coupled to an interlock valve 162 which is spring biased to the normally open position as shown in FIG. 5. In the open position, the interlock valve 162 allows the pressurized air to flow to a manually operated pendant shutoff valve 164, also shown in the open position. The interlock valve 162 is automatically closed as will be explained hereinafter during manual operation of the crane drive and when the rail interlocking and hoist stop apparatus 48 is engaged.

When the pendant shutoff valve 164 is open, the pressurized air is coupled to a pendant control valve 166 which directs the air to either a starboard drive line 168 or a port drive line 170 as selected manually by the crane operator. In FIG. 5, the various valves in the port and starboard drive circuits are shown in positions which couple the pressurized air to air motor 24 to drive the crane in the starboard direction and which disconnect the air supply from the port drive circuit. The pressurized air is coupled via line 168 from the pendant control valve 166 to a first quick release exhaust valve 172. Valve 172 is a pilot-actuated valve in which the signal to the pilot input 174 is tapped from the pressurized air on line 168 so that the pressurized air flows through the valve 172 when it is present on line 168.

The pressurized air is coupled from valve 172 to a second pilot-actuated quick exhaust valve 176 in which the air pressure on the input line is similarly tapped to provide the pilot signal to the pilot input 178. The pressurized air then flows through the valve 176 to drive the air motor 24 in a first direction. The exhaust of the air motor is coupled to a muffler 180.

The port drive circuit is identical to the starboard drive circuit. The pressurized air is coupled from pendant control valve 166 to a first pilot-actuated quick exhaust valve 182 which is actuated by a signal tapped from the input pressurized air. The pressurized air is then coupled to actuate and flow through a second pilot-actuated quick exhaust valve 184 which is coupled to drive the air motor 24 in the direction opposite to the first direction. The quick exhaust valves (valves 172 and 176 in the starboard drive circuit and valves 182 and 184 in the port drive circuit) provide a means for dumping air from one drive line when the motor 24 is to be driven in the opposite direction. For example, when the air pressure is disconnected from the port drive circuit and connected to the starboard drive circuit by switching the position of pendant control valve 166, there will be a residual back pressure in the line 190 connecting valve 184 to the air motor 24 and in the line 192 connecting valve 184 and valve 182. Since the back pressure opposes the rotation of the air motor in starboard direction, valves 184 and 182 are connected to provide a quick exhaust of lines 190 and 192, respectively. The residual air pressure actuates the pilot actuators 194 and 196, respectively, to switch the position of valves 182 and 184. As shown on FIG. 5, the residual air pressure line 190 is coupled through valve 184 to the muffler 180. The residual air pressure in line 192 is coupled through valve 182 to an exhaust port indicated by dashed line 198.

When the pressurized air is coupled to drive the air motor 24 in either direction, the output pressurized air from the pendant control valve 166 is also coupled to release a brake 199 on brake shaft 72 (see FIG. 3) which prevents movement of the crane drive shaft 28. The brake 199 is air released and spring set. The port and starboard output lines 168 and 170 are coupled to a pilot actuated valve 200 which is actuated to pass the pressurized air whenever there is pressure on either motor drive circuit. The air passing through valve 200 is pressure regulated to 40 psi (at 201) and coupled actuate a brake release valve 202 (shown in the unactuated position). The actuation of the brake release valve couples ships air from line 203 to release the brake 199. In the unactuated position, the brake release valve 202 provides an exhaust path 204 for residual air in the brake release line 206.

The ships air is also coupled to a manual interlock pilot valve 208 and a hoist stop interlock pilot valve 210 which function to disconnect ships air from the crane air motor drive circuitry when the crane is in manual operation or the rail interlocking and hoist stop apparatus is actuated. Valves 208 and 210 (shown in the closed position) which are spring-biased in the closed position, may be manually opened to allow flow of the ships air. When opened, valves 208 and 210 couple ships air to a pilot actuated valve 212 and also actuate the valve 212 to allow ships air to flow through the valve to a pilot actuator 214 on the interlock valve 162. The ships air applied to the actuator 214 disconnects the ships air from the air motor drive circuitry. Exhaust paths are provided to remove the back pressure from the lines between valve 162 and valve 208, valve 162 and valve 210, and valve 162 and the pendant shutoff valve 164.

Figure 6:
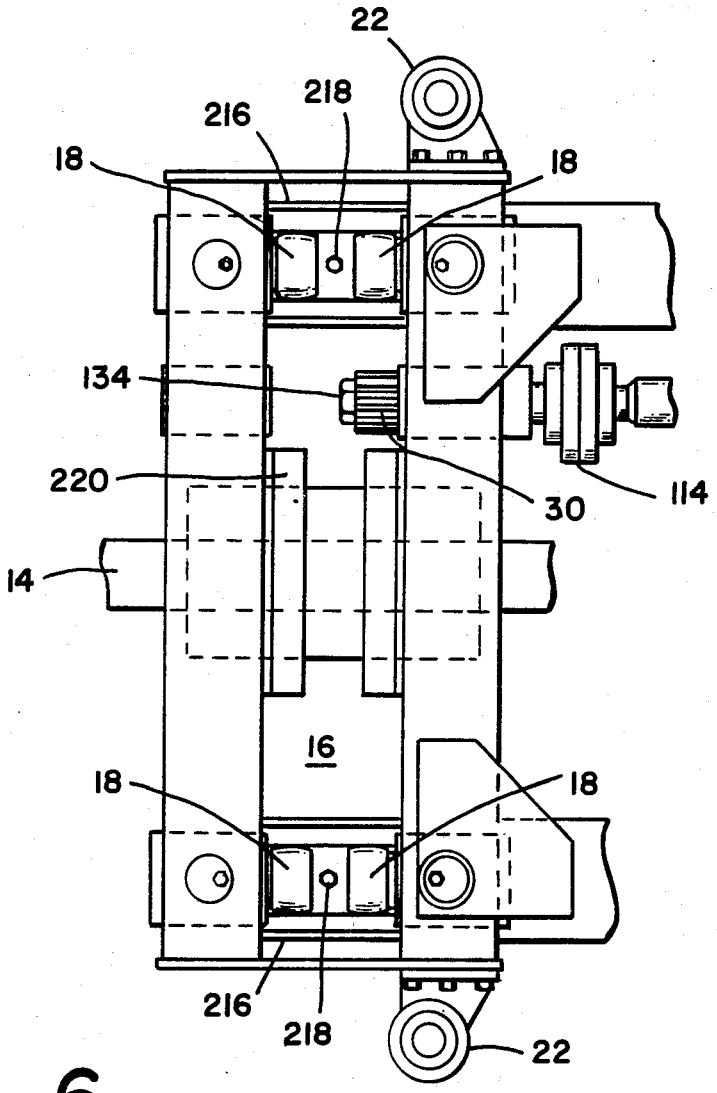
FIG. 6 is a partial plan view of the end of the crane.
Figure 7:
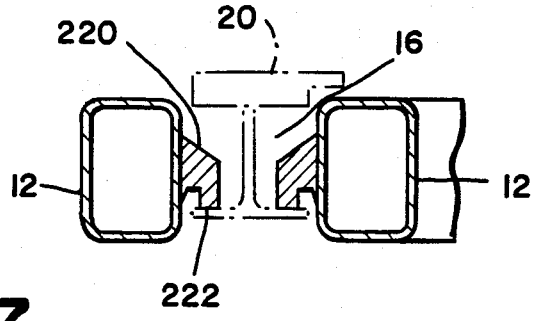
FIG. 7 is a vertical sectional view taken along line 7—7 in FIG. 6.

The crane is also provided with structure for protection against shocks from vertical impacts. Referring to FIGS. 2, 6 and 7, the structural plates 216 which run the length (that is, parallel to the hoist rail 14) of the crane and form the bottoms of the trucks 16 directly under the support wheels 18, are provided with a vertical shock stop 218 below each pair of support wheels. As best shown in FIG. 2, the vertical shock stop 218 is a bolt disposed in the bottom of the truck 16 which is oriented to absorb the impact between the crane and the bottom of the support rail 20 during vertical accelerations. As best shown in FIGS. 6 and 7, wedge shaped members 220 having spacers 222 are disposed over the support rails 20 to absorb the inpact between the crane and the top of the support rail during vertical acellerations.

What is claimed is:

1. An overhead crane for use in a shipboard environment, which comprises:

(a) a machinery carrying body, overhead rails mounted in said shipboard environment, said body having means for supporting said body for movement on said overhead rails;

(b) traversing means for moving said body along said overhead rails, said traversing means including (1) a source of pressurized air, an air motor mounted an said body, said air motor including an output shaft, a respective first and second air input means, said air motor being adapted to selectively receive pressurized air from said source at said first input for rotating said output shaft in a first direction, and at said second input for rotating said output shaft in a second direction;

(2) gear means having a gear input shaft coupled to said output shaft of said air motor and having a gear output shaft;

(3) a drive shaft coupled to said gear output shaft of said gear means and extending in said body between said overhead rails;

(4) gear rack means mounted on said overhead rails;

(5) drive pinions mounted on the distal ends of said drive shaft, said drive pinions being operative to engage said gear rack means on said overhead rail for moving said body therealong;

(6) means for manually rotating said gear input shaft to move said body along said overhead rails;

(c) brake means coupled to said gear input shaft for preventing movement of said crane, said brake means being normally mechanically engaged and pneumatically released when pressurized air is coupled to said air motor for traversing said crane;

(d) a load hoist means, rail means for supporting said hoist means, said rail means being removably attached to said body; and (e) a pneumatic control circuit for controlling the motion of said crane including (1) a first interlock valve receiving pressurized air, said first interlock valve being mechanically biased in the open position to allow passage of said pressurized air, said first interlock valve having a pneumatically operated pilot for closing said first interlock valve;

(2) a shutoff valve adapted to receive pressurized air from said first interlock valve, said shutoff valve being manually actuated to allow passage of said pressurized air in the open position or prevent passage of said pressurized air in the closed position;

(3) a manually actuated control valve adapted to received the pressurized air from said shutoff valve, said control valve when in a first position coupling said pressurized air to said first input of said air motor and in a second position coupling said pressurized air to said second input of said air motor; and (4) a brake release valve adapted to be actuated by said pressurized air from said control valve to release said brake means when actuated.

2. An overhead crane as recited in claim 1 wherein said pneumatic control circuit further comprises:

(a) a manually actuated interlock valve to couple pressure to the pilot of said first interlock valve to close said first interlock valve when said means for manually rotating said gear input shaft is engaged.

3. An overhead crane as recited in claim 2 further comprising:

(a) quick exhaust valve means disposed to receive the pressurized air from said manually actuated control valve and to allow passage of said pressurized air to said air motor, said quick exhaust valve means allowing release of the pressurized air coupled to said first air input of said air motor when pressurized air is coupled to said second air input to the air motor, said quick exhaust valve means allowing release of the pressurized air coupled to said second air input of said air motor when pressurized air is coupled to the first air input to the air motor.

* * * * *